United States Patent [19]

Wachter

[11] 4,180,082

[45] Dec. 25, 1979

[54] APPARATUS FOR MANUFACTURING CIGARETTES OR THE LIKE

[75] Inventor: Bernard Wachter, Kings Point, N.Y.

[73] Assignee: Pyro Dynamics, Ltd., Hicksville, N.Y.

[21] Appl. No.: 910,439

[22] Filed: May 30, 1978

[51] Int. Cl.[2] ..... A24C 5/42

[52] U.S. Cl. ..... 131/26; 131/68; 131/58

[58] Field of Search ..... 131/26, 58, 68, 69, 131/75, 70

[56] References Cited

U.S. PATENT DOCUMENTS

| | | | |
|---|---|---|---|
| 1,170,147 | 2/1916 | Greer | 131/75 X |
| 1,920,955 | 8/1933 | Burri | 131/58 |
| 2,015,312 | 9/1935 | Kappeler | 131/58 |
| 2,868,209 | 1/1959 | Marcotte | 131/58 |

*Primary Examiner*—Stephen C. Pellegrino
*Attorney, Agent, or Firm*—John J. Byrne

[57] ABSTRACT

Disclosed is apparatus for manufacturing cigarettes, cigarillos, and the like. The apparatus comprises a housing, a tray for receiving and measuring a charge of a smokable substance, a cylindrical form for forming a cigarette or the like, and means for opening and closing the form. The tray, which is preferably cylindrical in shape, is open on one side, movable from a first position within the housing to a second position exterior of the housing, and rotatable from a first orientation in which it is open upwardly to a second orientation in which it is open downwardly. The form is located beneath the tray, movable from a first position within the housing to a second position exterior of the housing, divided into two semi-cylindrical form components, and hinged along its axial length between the semi-cylindrical form components to permit opening and closing. To charge the form, it is opened upwardy and the tray is rotated to its second position, allowing a charge of a smokable substance to drop from the tray into the form. To release a completed cigarette or the like, the form is opened downwardly, allowing the completed smoking product to drop from the form.

13 Claims, 6 Drawing Figures

APPARATUS FOR MANUFACTURING CIGARETTES OR THE LIKE

FIELD OF THE INVENTION

This invention relates to apparatus for manufacturing cigarettes, cigarillos, or the like (hereinafter referred to collectively as "cigarettes"). The apparatus is particularly, though not exclusively, adapted for "home" manufacturing of cigarettes by the consumer.

BACKGROUND OF THE INVENTION

Various devices for the home manufacturing of cigarettes are already known. All are, however, fairly complicated and thus expensive to manufacture and susceptible to severe maintenance problems, particularly since the users of such devices are unlikely to treat them with care.

OBJECT OF THE INVENTION

It is, therefore, a principal object of the present invention to provide a device for the home manufacturing of cigarettes which is simple, sturdy, inexpensive to manufacture, and requires little or no maintenance.

DETAILED DESCRIPTION OF THE PRESENTLY PREFERRED EMBODIMENT

Figure 1:
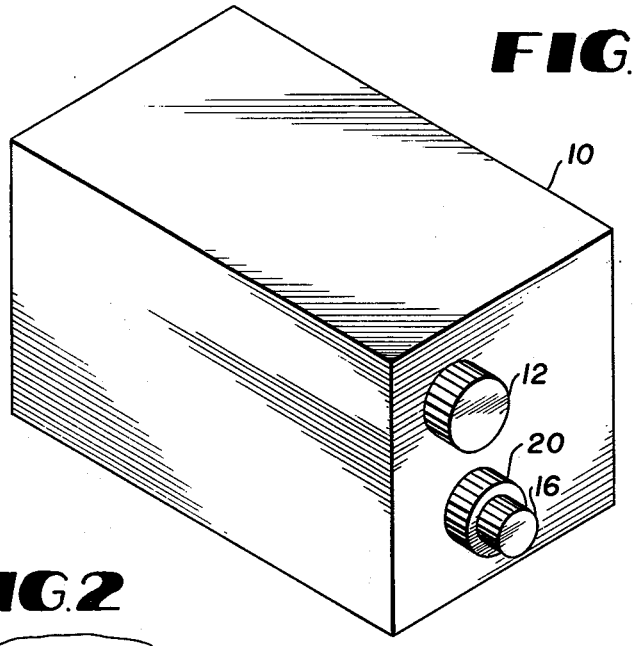
FIG. 1 is a perspective view of the presently preferred embodiment of the present invention showing the tray and the form both within the housing.

Referring first to FIG. 1, there will be seen an exterior view of the presently preferred embodiment of the present invention. Visible in this view are a housing 10, a knob 12 for manipulating a tray 14 (showin in FIGS. 2–6), a knob 16 for manipulating a form 18 (shown in FIGS. 3–6), and a knob 20 for manipulating a curved member 22 (shown in FIGS. 3–6). Optionally the apparatus can also include a pan (not shown) slidingly disposed in the housing 10 beneath the knobs 16 and 20 to catch fragments of tobacco or the like dropped in filling the tray 14 or during use of the apparatus and to catch the finished cigarettes.

Figure 2:
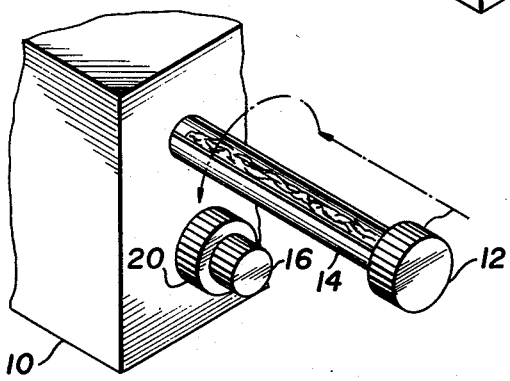
FIG. 2 is a fragmentary perspective view of the presently preferred embodiment showing the tray in its exterior position.

Referring next to FIG. 2, the tray 14 will be seen in its exterior, or loading, position. As shown, the tray 14 is preferably cylindrical in shape. In any event, it is open on one side, and the interior of the tray is sized to accommodate a single charge of tobacco or the like. The tray 14 is movable from a first position (shown in FIG. 1) within the housing 10 to a second position (shown in FIG. 2) exterior of the housing 10. Preferably that movement is linear, as shown, but quite conceivably the movement could be pivotal or compound. In any event, the tray 14 is rotatable from a first orientation (shown in FIG. 2) in which it is open upwardly to a second orientation in which it is open downwardly. Preferably detent means (not shown) are provided, either to preclude removal of the tray 14 from the housing altogether or to preclude removal until a retaining force has been overcome.

Referring next to FIGS. 3 through 6, the operation of the tray 14 and the form 18 in manufacturing a cigarette will be explained.

Figure 3:
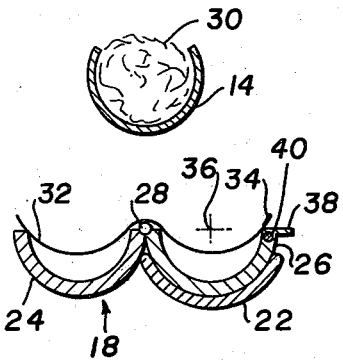
FIGS. 3 through 5 are schematic cross-sectional views of the tray and the form showing the actuation of the tray and the form in manufacturing a cigarette.

In FIG. 3, the tray 14 and the form 18 are both shown in their upwardly open positions. The form 18 comprises two semi-cylindrical form components 24 and 26 hinged at 28 along their axial length to permit opening and closing of the form. A charge 30 of tobacco or the like is shown in the tray 14, and a sheet 32 of cigarette paper having a strip 34 of heat-sealable adhesive along one edge is shown disposed in the form 18.

Figure 4:
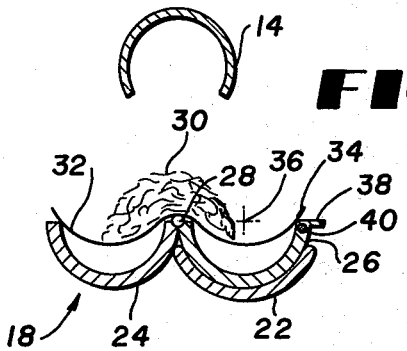

In FIG. 4, the tray 14 has been rotated by the knob 12, allowing the charge 30 to drop onto the sheet 32.

Figure 5:
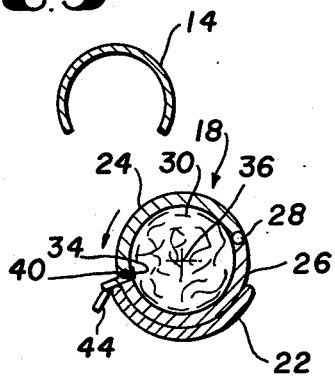

In FIG. 5, the semi-cylindrical form component 26 has been rotated counterclockwise about its axis 36 by the knob 16. The rotational movement of the semi-cylindrical form component 26 forces the semi-cylindrical form component 24 against the left edge of the curved member 22, which is held stationary during this operation by means not shown. The contact with the edge of the curved member 22 causes the semi-cylindrical form component 24 to pivot about the hinge 28, closing the form 18 and wrapping the sheet 32 around the charge 30 within the form 18. At the end of the desired rotation, a projection 38 on the leading edge of the semi-cylindrical form component 26 comes to rest against the left edge of the curved member 22, preventing further rotation of the knob 16. In this position, current is passed through a heating element 40, preferably carried by the form 18 along its axial length, to heat seal the strip 34, completing the manufacture of the cigarette.

Figure 6:
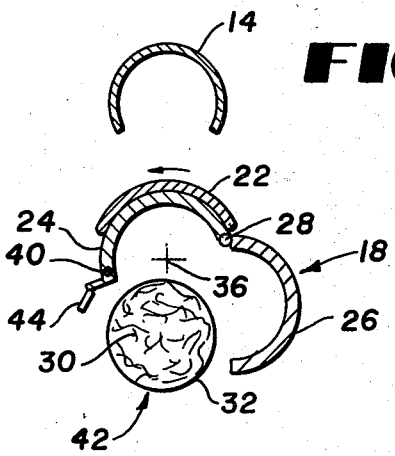

In FIG. 6, the curved member 22 has been rotated counterclockwise about its axis by the knob 20. The curved member 22 is located exteriorly of the form 18 and receives the form 18 concentrically. Thus, the axis 36 of the form component 24 and the curved member 22 are coincident, and rotation of the curved member 22 from a first position (shown in FIG. 5) in which it contacts the form component 26 and holds it in its closed position to a second position (shown in FIG. 6) in which it does not contact the form component 26 allows the form component 26 to rotate about the hinge 28 to its open position. The rotation of the form component 26 about the hinge in turn allows the finished cigarette 42 to drop from the form 18. A stop 44 carried by the housing 10 in any appropriate manner is preferably provided to prevent rotation of the form 18 when the curved member 22 is rotated.

As will be readily apparent, the steps described above are simply reversed to return the apparatus to its starting position.

Preferably the tray 14 and the form 18 are rotatable when they are in their exterior positions, so that the charge 30 is dropped from the tray 14 to the form 18 when both are exterior to the housing 10. However, the tray 14 and the form 18 may be made additionally or alternatively rotatable when they are in their recessed positions, so that the charge 30 may be dropped from the tray 14 to the form 18 when both are interior of the housing 10. Similarly, the completed cigarette 42 is preferably released exteriorly of the housing 10, but it may be released interiorly of the housing 10.

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appealed hereto and not by the foregoing preferred embodiment.

What is claimed is:

1. Apparatus for manufacturing cigarettes or the like, said apparatus comprising:
   (a) a housing;
   (b) a tray which is
      (i) open on one side,
      (ii) movable from a first position within said housing to a second position exterior of said housing, and
      (iii) rotatable from a first orientation in which said tray is open upwardly to a second orientation in which said tray is open downwardly;
   (c) a cylindrical form which is
      (i) located beneath said tray,
      (ii) movable from a first position within said housing to a second position exterior of said housing,
      (iii) divided into two semi-cylindrical form components; and
      (iv) hinged along its axial length between the semi-cylindrical form component to permit opening and closing of said form;
   (d) first means for opening and closing said form
      (i) along its axial hinge
      (ii) so that said form is open upwardly, at which time it is positioned to receive a charge of tobacco or the like dropped from said tray onto a sheet of wrapping material located on said form, and closed around said charge of tobacco and sheet of wrapping material to form a cigarette; and
   (e) second means for opening said form
      (i) along its axial hinge
      (ii) so that said form is open downwardly, at which time it is positioned to release the completed cigarette or the like.

2. Apparatus as recited in claim 1 wherein said tray is cylindrical in shape.

3. Apparatus as recited in claim 1 and further comprising third means for heat sealing the sheet of wrapping material about the charge of tobacco or the like within said form.

4. Apparatus as recited in claim 3 wherein said third means comprises a heating element carried by said form along its axial length.

5. Apparatus as recited in claim 1 wherein:
   (a) said tray is rotatable when it is in its second position and
   (b) said first means opens said form when it is in its second position, whereby the charge is dropped from said tray to said form while both said tray and said form are exterior of said housing.

6. Apparatus as recited in claim 1 wherein said second means opens said form when it is in its second position, whereby the completed cigarette or the like is released exteriorly of said housing.

7. Apparatus as recited in claim 1 wherein said form is rotatable about the axis of one of the semi-cylindrical form components.

8. Apparatus as recited in claim 7 wherein said first means comprise:
   (a) fourth means for rotating said one of the semi-cylindrical form components about its axis and
   (b) fifth means for rotating the other one of the semi-cylindrical form components about the axial hinge.

9. Apparatus as recited in claim 8 wherein said fifth means comprises a curved member which
   (a) is located exteriorly of said form,
   (b) receives said form concentrically, and
   (c) is stationary during operation of said first means.

10. Apparatus as recited in claim 7 wherein said second means comprise a curved member which:
   (a) is located exteriorly of said form,
   (b) receives said form concentrically, and
   (c) is rotatable about its axis
      (i) from a first position in which it contacts the other one of the semi-cylindrical form components and holds it in its closed position
      (ii) to a second position in which it does not contact said other one of the semi-cylindrical form components, allowing said other one of the semi-cylindrical form components to rotate about the axial hinge to its open position.

11. Apparatus as recited in claim 10 wherein said second means further comprises a stop which prevents rotation of said form when said curved member is rotated.

12. Apparatus as recited in claim 1 wherein said tray moves linearly from its first to its second position.

13. Apparatus as recited in claim 1 wherein said form moves linearly from its first to its second position.

* * * * *